US005566842A

United States Patent [19]

Dennis

[11] Patent Number: 5,566,842

[45] Date of Patent: Oct. 22, 1996

[54] HOLDER FOR STORING A TOOTHPASTE DISPENSER AND TOOTHBRUSHES

[76] Inventor: Breeze R. H. Dennis, 3412 Griffin, #1605, Fort Worth, Tex. 76133

[21] Appl. No.: 305,045

[22] Filed: Sep. 13, 1994

[51] Int. Cl.[6] ..... A47F 7/00

[52] U.S. Cl. ..... 211/87; 211/65; 211/88; D6/530; D6/545

[58] Field of Search ..... 211/87, 65, 60.1, 211/71, 88, 113, 75; 248/682, 108, 309.1; D6/528, 530, 545, 534

[56] References Cited

U.S. PATENT DOCUMENTS

| | | | |
|---|---|---|---|
| 670,481 | 3/1901 | Kirkwood | 211/87 |
| 1,291,349 | 1/1919 | Ackers | 211/65 X |
| 1,615,571 | 1/1927 | Crecelius | 211/75 X |
| 1,955,736 | 4/1934 | Claytor et al. | 211/88 X |
| 1,975,691 | 10/1934 | Hibbs | 211/88 X |
| 2,200,046 | 5/1940 | Straus | 211/65 X |
| 2,415,447 | 2/1947 | Stanton | 211/65 X |
| 2,897,531 | 8/1959 | Calabrese | 211/65 X |
| 2,956,687 | 10/1960 | Robichaud | 211/65 X |
| 4,140,222 | 2/1979 | Francavilla | 211/65 |
| 4,219,035 | 8/1980 | Deconinck | 211/65 |

*Primary Examiner*—Robert W. Gibson, Jr.
*Attorney, Agent, or Firm*—John M. Harrison

[57] ABSTRACT

A holder for holding a toothpaste pump dispenser and toothbrushes is provided. The holder has a base which is mounted to a vertical wall. A cup is coupled to the base so as to extend out from the wall. The cup receives and holds a toothpaste dispenser therein. The cup has an upper edge which permits a dispenser nozzle of the toothpaste dispenser to be operated so that toothpaste may be dispensed from the nozzle while the dispenser is located in the cup. Toothbrush mounts are also coupled to the base extending away from the wall. The toothbrush mounts receive and support toothbrushes on the holder.

5 Claims, 1 Drawing Sheet

HOLDER FOR STORING A TOOTHPASTE DISPENSER AND TOOTHBRUSHES

FIELD OF THE INVENTION

The present invention relates to an apparatus for storing a toothpaste dispenser and toothbrushes in a convenient storage position on a vertical wall, and in particular to a holder which stores a toothpaste dispenser in an operative position.

DESCRIPTION OF THE RELATED ART

Toothpaste dispensers and toothbrushes are commonly used in dental hygiene. Toothpaste dispensers which dispense toothpaste by a pumping action have become increasingly popular and are commonly used. "Pump action" dispensers typically stand upright and dispense toothpaste through a nozzle upon pushing down on the top of the dispenser.

Typically "pump action" toothpaste dispensers and toothbrushes are stored in separate locations about a sink area. For example, the dispenser may be located on a counter adjacent the sink and the toothbrushes may be stored in a holder mounted to the wall or in a cup adjacent the sink. A person needing to brush his or her teeth must locate both a toothbrush and the toothpaste dispenser before brushing. Often, the dispenser or toothbrush is misplaced, resulting in a search for the missing item.

What is needed is a holder which secures the toothpaste dispenser and toothbrushes in a single location, and in which the dispenser may dispense toothpaste while located in the holder.

SUMMARY OF THE INVENTION

It is an object of the invention to provide a holder for holding a pump action toothpaste dispenser and multiple toothbrushes, where the holder is structured to permit toothpaste to be dispensed from the toothpaste dispenser when the dispenser is located in the holder.

A holder apparatus is provided having a base, a cup, and a toothbrush mounting member. The base is structured and arranged for mounting to a vertical wall. The cup is coupled to the base so as to extend outward from the vertical wall. The cup defines a cavity for receiving a toothpaste dispenser. The cup has a bottom wall for supporting the toothpaste dispenser in the cavity. The cup is structured and arranged to permit operation of the toothpaste dispenser when the toothpaste dispenser is located in the cup. The toothbrush mounting member is also coupled the base so as to extend outward from the vertical wall. The toothbrush mounting member is structured and arranged to support a toothbrush.

In one aspect of the invention, the cup has an upper edge. The upper edge of the cup and the base define an opening that communicates with the cavity. The opening receives the toothpaste dispenser therethrough. The upper edge of the cup has a notch therein in which a dispenser nozzle of the toothpaste dispenser is located when the dispenser is located in the cup. The notch extends lengthwise transverse to the upper edge of the cup, and the nozzle is moveable lengthwise in the notch so that the dispenser may dispense toothpaste.

In another aspect of the invention, the cup has an upper edge which, cooperatively with the base, defines an opening that communicates with the cavity. The opening receives the toothpaste dispenser therethrough. The upper edge of the cup extends below a dispenser nozzle of the toothpaste dispenser when the dispenser is located in the cup. The nozzle is transversely movable with respect to the upper edge so that the dispenser may dispense toothpaste.

In a further aspect of the invention, the toothbrush mounting member is comprised of a hook mounted to the base. The hook is structured and arranged to fit through an aperture in a toothbrush handle.

In yet a further aspect of the invention, a plurality of toothbrush mounting members are coupled to the base extending outward from the vertical wall.

DESCRIPTION OF THE PREFERRED EMBODIMENTS

Figure 1:
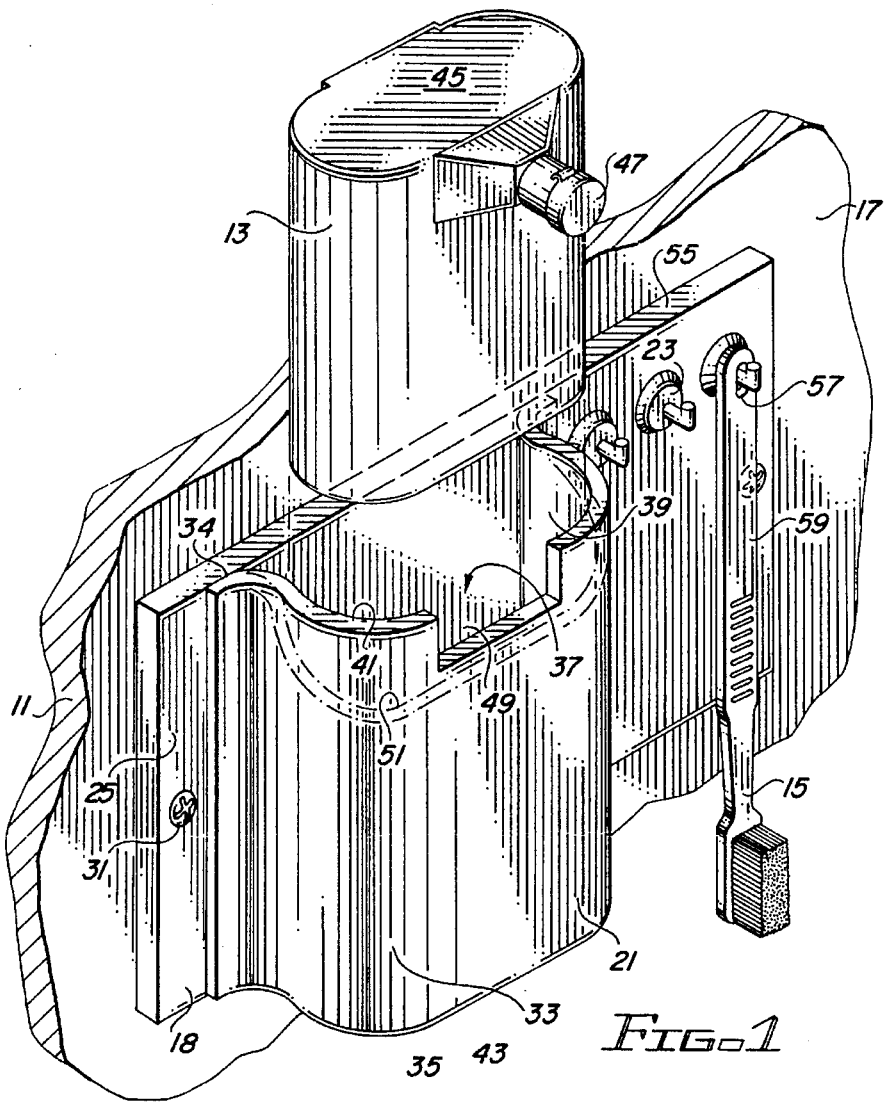
FIG. 1 is an isometric view of the holder of the current invention in accordance with a preferred embodiment, showing a toothpaste dispenser exploded out from the cup of the holder, and showing a toothbrush mounted on the holder.

Referring to FIG. 1, the toothbrush and toothpaste holder 11 of the current invention is shown. The holder 11 retains a toothpaste dispenser 13 and plural toothbrushes 15 together in a single convenient location. The holder 11 mounts to a vertical wall 17, preferably near a sink (not shown) used for toothbrushing purposes. The toothpaste dispenser 13 dispenses toothpaste while being retained in the holder 11. The toothpaste dispenser 13 is removably located in the holder 11 so that the dispenser 13 may be replaced in the holder 11 after the dispenser 13 is emptied of toothpaste. The holder 11 may hold multiple toothbrushes 15 so that each user of the holder 11 may store a toothbrush thereon.

The holder 11 has a base 19 which supports a toothpaste retainer 21 and toothbrush mounts 23 for holding the toothpaste dispenser 13 and the toothbrushes 15, respectively. The base 19 is a plate which mounts on the vertical wall 17 to support the holder 11 on the wall 17. As shown FIG. 2, the base 19 has a front face 25 and a rear face 27 coupled by edges 29. The rear face 27 of the base 19 is flat, enabling the rear face 27 to be located flush against the wall 17. In a preferred embodiment the base 19 is formed of a durable plastic material.

Referring back to FIG. 1, the base 19 is securely mounted to the wall 17 so the toothpaste retainer 21 and toothbrush mounts 23 may support a toothpaste dispenser 13 and toothbrushes 15. In a preferred embodiment, screws 31 extend through the base 19 from the front face 25 to the rear face 27 and into the wall 17 to secure the base 19 to the wall 17. Other means may be used to secure the base 19 to the wall 17 including adhesives, loops for being secured over nails in the wall, or other conventional means of hanging objects on vertical walls.

Figure 2:
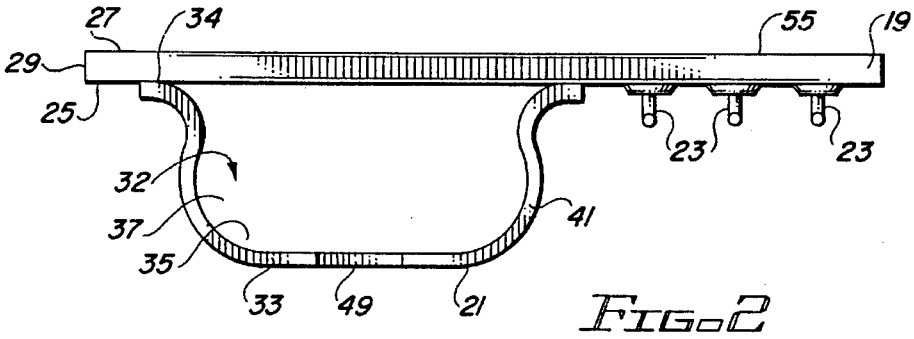
FIG. 2 is a top view of the holder.

Referring to FIGS. 1 and 2, the toothpaste retainer 21 is formed by a retaining wall 33 and a bottom wall 35 extending from and integrally coupled to the front face 25 of the base 19. The retaining wall 33 and bottom wall 35, in cooperation with the base 17, form a cup for receiving a toothpaste dispenser. The retaining wall 33 has a substantially oval cross section shape to receive an oval shaped toothpaste dispenser 13. The retaining wall 33 may be formed in a different shape to retain a toothpaste dispenser 13 having a shape other than an oval shape. The inner edges 34 of the retaining wall 33 are flared to securely attach the retaining wall 33 to the base 19 along the inner edges 34.

The retaining wall 33 and the front face 25 of the base 19 cooperatively define a cavity 37 into which the dispenser 13 may be located. An opening 39 defined by the upper edge 41 of the retaining wall 33 and the front face 25 of the base 19 communicates with the cavity 37 so that the dispenser 13 may be located in the cavity 37 through the opening 39. The bottom wall 35 supports the dispenser 13 in the cavity 37 and is integrally coupled across the lower edge 43 of the retaining wall 33. The retaining wall 33 is shorter, from the lower edge 43 to the upper edge 41, than the toothpaste dispenser 13 so the top 45 of the dispenser 13 extends out of the retainer 21 positioned to be depressed to dispense toothpaste. In a preferred embodiment, the retaining wall 33, bottom wall 35, and the base 19 are formed of an integral piece of molded plastic.

As shown in FIG. 1, the upper edge 41 of the retaining wall 33 of the toothpaste retainer 21 is shaped to receive a dispensing nozzle 47 of the toothpaste dispenser 13. In one embodiment of the invention, a notch 49 is located in the upper edge 41 positioned to receive the dispensing nozzle 47. The nozzle 47 is located extending through the notch 49 when the toothpaste dispenser 13 is supported on the bottom wall 35 in the toothpaste retainer 21. The notch 49 extends downwards from the upper edge 41 of the retaining wall 33 a sufficient distance to allow downward movement of the nozzle 47 in the notch 49 so the top 45 of the toothpaste dispenser 13, including the nozzle 47, may be depressed to dispense toothpaste through the nozzle 47.

In another embodiment of the invention, shown in dashed lines in FIG. 1, the toothpaste retainer 21 has an upper edge 51 that is located below the nozzle 47 of the toothpaste dispenser 13 when the dispenser 13 is located on the bottom wall 35 of the toothpaste retainer 21. The upper edge 51 is located a sufficient distance below the nozzle 47 to allow the top 45 of the toothpaste dispenser 13, including the nozzle 47, to be depressed to dispense toothpaste through the nozzle 47.

Referring now to FIGS. 1 and 2, the toothbrush mounts 23 are shown. The toothbrush mounts 23 are coupled to the base 19 spaced apart from the toothpaste retainer 21. Each toothbrush mount 23 is secured to the front face 25 of the base 19. In the preferred embodiment, each toothbrush mount 23 is a hook screw which is screwed into the base 19. The hook screw has a hook end that extends outward from the base 19 so as to receive and retain a toothbrush 15. The toothbrush mounts 23 are located spaced apart from each other near the top edge 55 of the base 19 so that a toothbrush 15 may be hung from a mount 23. The base 19 may be sized to permit any desired number of toothbrush mounts 23 to be mounted thereon.

The holder 11 is easily installed and used. In order to install the holder 11, the holder 11 is mounted in a desired location, typically adjacent a bathroom sink, by securing the holder 11 to a vertical wall 17 with screws 31. The screws 31 are driven into the wall 17 to couple the holder 11 to the wall 17 in a conventional manner.

After the holder 11 is mounted to the wall 17 the holder 11 is prepared for use by installing the toothpaste dispenser 13 in the retainer 21 and installing the toothbrushes 15 on the hooks 23. The toothpaste dispenser 13 is inserted into the toothpaste retainer 21 so the dispenser 13 rests on the bottom wall 35 with the nozzle 47 being located in the notch 49 of the retaining wall 33 or extending over the upper edge 51 of the retaining wall 33 positioned to dispense toothpaste. The toothbrushes 15 are placed on the holder 11 by locating the toothbrush aperture 57 of each toothbrush 15 onto a respective toothbrush mount 23.

To use the holder 11, a toothbrush 15 is selected and removed from its toothbrush mount 23 by slipping the toothbrush aperture 57 off of the toothbrush mount 23. The toothbrush 15 is located under the nozzle 47 of the dispenser 13, wherein it is positioned to receive toothpaste from the nozzle 47. The dispenser 13 is of the "pump" type. The top 45 of the dispenser 13 is pushed down to apply toothpaste to the toothbrush 15 through the nozzle 47. As the top 45 is depressed, the dispenser bears down on the bottom wall 35. The toothbrush 15 is then used and subsequently cleaned. The clean toothbrush is replaced for storage on the holder 11 by slipping the toothbrush aperture 57 onto the toothbrush mount 23.

The toothpaste dispenser 13 may be replaced in the toothpaste retainer 21 after the supply of toothpaste in the dispenser 13 is exhausted. The dispenser 13 is removed from the retainer 21 by grasping the top 45 of the dispenser 13 and pulling the dispenser 13 upwards out of the retainer 21. A new supply of toothpaste may be located in the toothpaste retainer 21 by placing a full new toothpaste dispenser 13 in the retainer 21 or by refilling the old dispenser 13 with a new supply of toothpaste and reinserting the old dispenser 15 into the retainer 21.

Such toothpaste dispensers 13 are conventional and commercially available. There may be some variation as to cross-sectional size and shape between toothpaste dispensers 13 made by different manufacturers. Of course, for ease of use by the consumer, it is desirable that the dispensers be made of uniform size and shape. However, the toothpaste retainer 21 can be sized to fit one particular type of dispenser. Alternatively, the dispenser can be sized to fit the largest size of dispenser. Should a smaller size dispenser be located within the retainer 21, then shims (made of plastic, paper, wood, etc.) can be inserted between dispenser and the retainer walls in order to create a snug fit of the dispenser inside of the retainer.

The retainer 21 and the base 17 can be of a molded one piece construction. Likewise, the hooks 23 can also be molded onto the base. Alternatively, the retainer can be secured to the base by a suitable adhesive.

The foregoing disclosure and showings made in the drawings are merely illustrative and should not be interpreted in a limiting sense.

I claim:

1. A tooth care equipment retaining apparatus for mounting on a wall, comprising:

a base mounted on the wall;

a cup coupled to said base, said cup and said base defining a cavity therebetween;

a toothpaste pump dispenser removably located in said cavity, a depressible top section and a dispenser nozzle provided on said toothpaste pump dispenser, wherein said nozzle dispenses toothpaste from said toothpaste pump dispenser responsive to operation of said depressible top section; and at least one toothbrush mounting member coupled to said base.

2. The tooth care equipment retaining apparatus of claim 1, wherein:

said cup has an upper edge, where said upper edge and said base cooperatively define an opening that communicates with said cavity, said opening receiving said toothpaste pump dispenser therethrough; and said upper edge has a notch therein in which said dispenser nozzle of said toothpaste pump dispenser is located, where said notch extends lengthwise along said cup transverse to said upper edge, said nozzle being movable along said length of said notch to dispense toothpaste.

3. The tooth care equipment retaining apparatus in claim 2, wherein:

said toothbrush mounting member comprises at least one hook mounted to said base.

4. The tooth care equipment retaining apparatus of claim 1, wherein:

said cup has an upper edge, where said upper edge and said base cooperatively define an opening that communicates with said cavity, said opening receiving said toothpaste pump dispenser therethrough; and said upper edge of said cup extends below said nozzle of said toothpaste pump dispenser, said upper edge of said cup being spaced from said nozzle whereby said nozzle may be moved downward transverse to said upper edge to dispense toothpaste responsive to operation of said depressible top section.

5. The tooth care equipment retaining apparatus of claim 4, wherein:

said toothbrush mounting member comprises at least one hook mounted to said base.

* * * * *